US008943626B1

(12) United States Patent
Stephens

(10) Patent No.: US 8,943,626 B1
(45) Date of Patent: Feb. 3, 2015

(54) PILLOW DISPLAY SYSTEM

(71) Applicant: Martha Stephens, Odessa, TX (US)

(72) Inventor: Martha Stephens, Odessa, TX (US)

( * ) Notice: Subject to any disclaimer, the term of this patent is extended or adjusted under 35 U.S.C. 154(b) by 0 days.

(21) Appl. No.: 14/088,561

(22) Filed: Nov. 25, 2013

(51) Int. Cl.
*A47C 20/00* (2006.01)
*F16M 13/00* (2006.01)
*A47G 9/02* (2006.01)
*A47G 9/10* (2006.01)

(52) U.S. Cl.
CPC ..... *F16M 13/00* (2013.01); *A47G 9/0253* (2013.01); *A47G 9/10* (2013.01)
USPC ..... 5/636; 5/639; 5/640; 5/643; 5/490; 5/491; 5/492

(58) Field of Classification Search
USPC ..... 5/636, 639, 640, 643, 490, 491, 492; 40/745, 748; 248/466, 469, 475.1, 248/346.03
See application file for complete search history.

(56) References Cited

U.S. PATENT DOCUMENTS

| | | | | |
|---|---|---|---|---|
| 359,617 | A | 3/1887 | Leonard | |
| 670,194 | A * | 3/1901 | Cashin | 5/492 |
| 695,555 | A * | 3/1902 | Hebert | 160/368.2 |
| 908,170 | A * | 12/1908 | Van Der Boom | 40/739 |
| 929,810 | A | 8/1909 | Yenner | |
| 1,140,583 | A | 5/1915 | Elliott | |
| 2,131,609 | A * | 9/1938 | Alexander | 248/231.41 |
| 2,505,232 | A * | 4/1950 | Cristiani | 40/733 |
| 2,986,202 | A | 5/1961 | Yates | |
| 3,346,892 | A | 10/1967 | Du Priest | |
| 3,956,837 | A * | 5/1976 | Itano | 40/745 |
| 4,015,542 | A * | 4/1977 | Gutridge et al. | 105/322 |
| 4,074,373 | A * | 2/1978 | Garofalo | 5/640 |
| D257,105 | S | 9/1980 | Morris | |
| 4,757,623 | A * | 7/1988 | Seyler | 40/780 |
| 5,197,213 | A * | 3/1993 | Borden | 40/737 |
| 5,201,133 | A * | 4/1993 | Best et al. | 40/773 |
| 5,335,433 | A * | 8/1994 | Borden | 40/737 |
| D382,755 | S | 8/1997 | Knopfler | |
| 6,839,923 | B2 | 1/2005 | Blessman | |
| 7,047,678 | B1 * | 5/2006 | Hall et al. | 40/299.01 |
| 7,257,916 | B2 * | 8/2007 | Hall et al. | 40/672 |
| 7,301,759 | B2 * | 11/2007 | Hsiung | 361/679.27 |
| 7,901,754 | B2 * | 3/2011 | Nicastri | 428/99 |
| 7,971,294 | B1 | 7/2011 | Murauskos | |
| 8,079,166 | B2 * | 12/2011 | Li et al. | 40/748 |
| 2006/0026872 | A1 * | 2/2006 | Hall et al. | 40/299.01 |
| 2014/0000037 | A1 * | 1/2014 | Donohue | 5/639 |

* cited by examiner

*Primary Examiner* — Robert G Santos
*Assistant Examiner* — David E Sosnowski

(57) ABSTRACT

A system for displaying a pillow in a vertical position features a pillow and a sham located on and fully encasing the pillow. The sham features a flange located on a sham outer periphery and extending out and away from the sham. A second attachment means is located on a flange second surface. The system features a rigid display frame with a frame aperture centrally located in the display frame. A first attachment means is located on a frame first surface. A removable base is located on a frame bottom edge perpendicular to the display frame.

2 Claims, 10 Drawing Sheets

(Exploded View)

(Back View)

(Top View)

(Side View with cross-section)

(End of Bed View)

PILLOW DISPLAY SYSTEM

FIELD OF THE INVENTION

The present invention relates to display systems for pillows.

BACKGROUND OF THE INVENTION

Pillows have been decoratively displayed for many years. Often, when the pillows are positioned, they tend to slump or lean away from the desired position. The present invention features a system for displaying a pillow in a vertical position.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a system for displaying a pillow in a vertical position. In some embodiments, the system comprises a pillow. In some embodiments, the system comprises a sham located on and fully encasing the pillow. In some embodiments, the sham comprises a flange located on a sham outer periphery and extending out and away from the sham. In some embodiments, a second attachment means is located on a flange second surface.

In some embodiments, the system comprises a rigid display frame. In some embodiments, a frame aperture is centrally located in the display frame. In some embodiments, a first attachment means is located on a frame first surface. In some embodiments, a removable base is located on a frame bottom edge.

DESCRIPTION OF PREFERRED EMBODIMENTS

Figure 1:
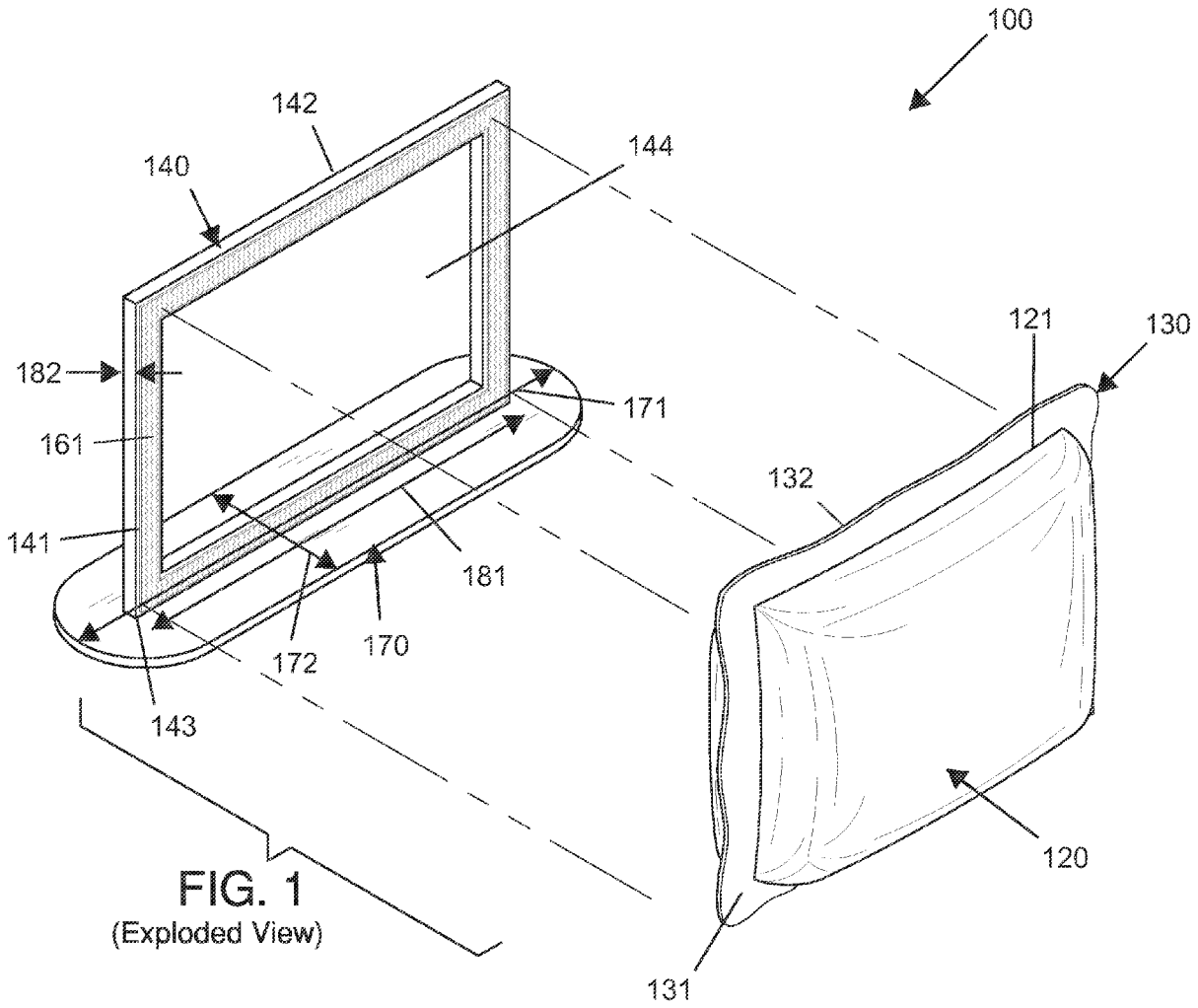
FIG. 1 shows a perspective view of the components of the present invention.
Figure 2:
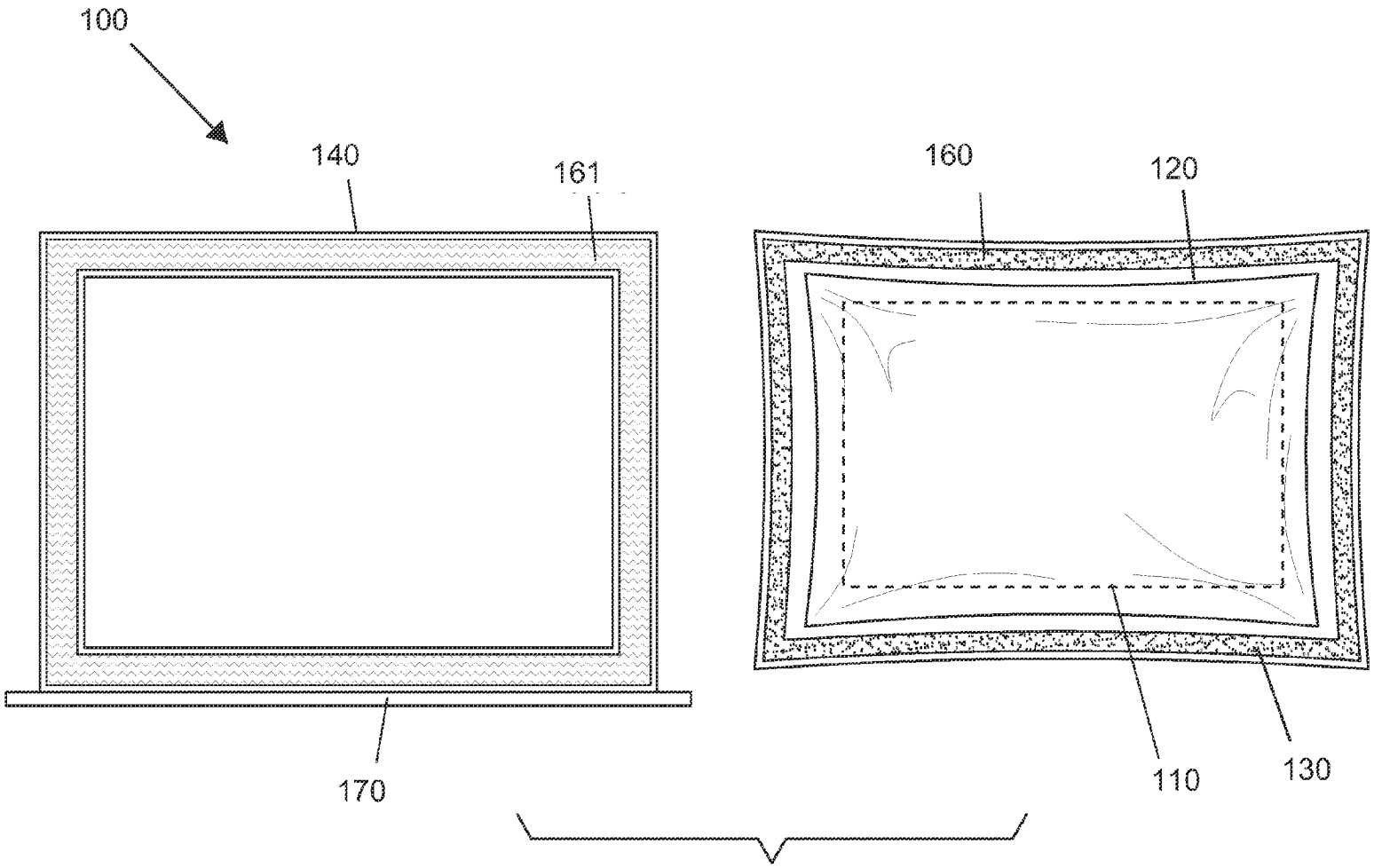
FIG. 2 shows a front view of the components of the present invention.
Figure 3:
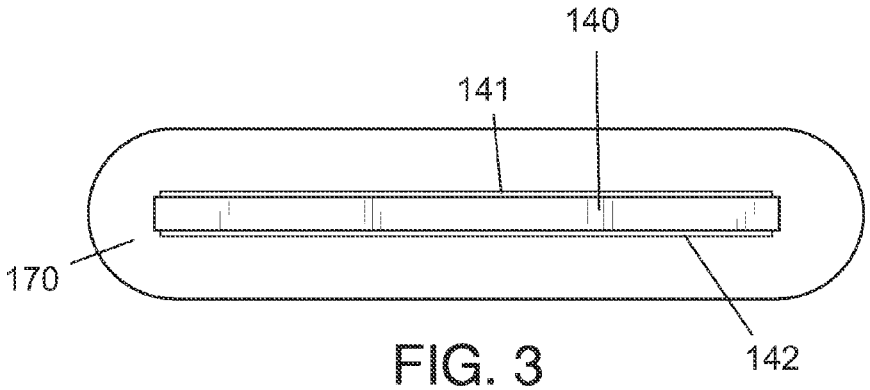
FIG. 3 shows a top view of the display frame of the present invention.
Figure 4:
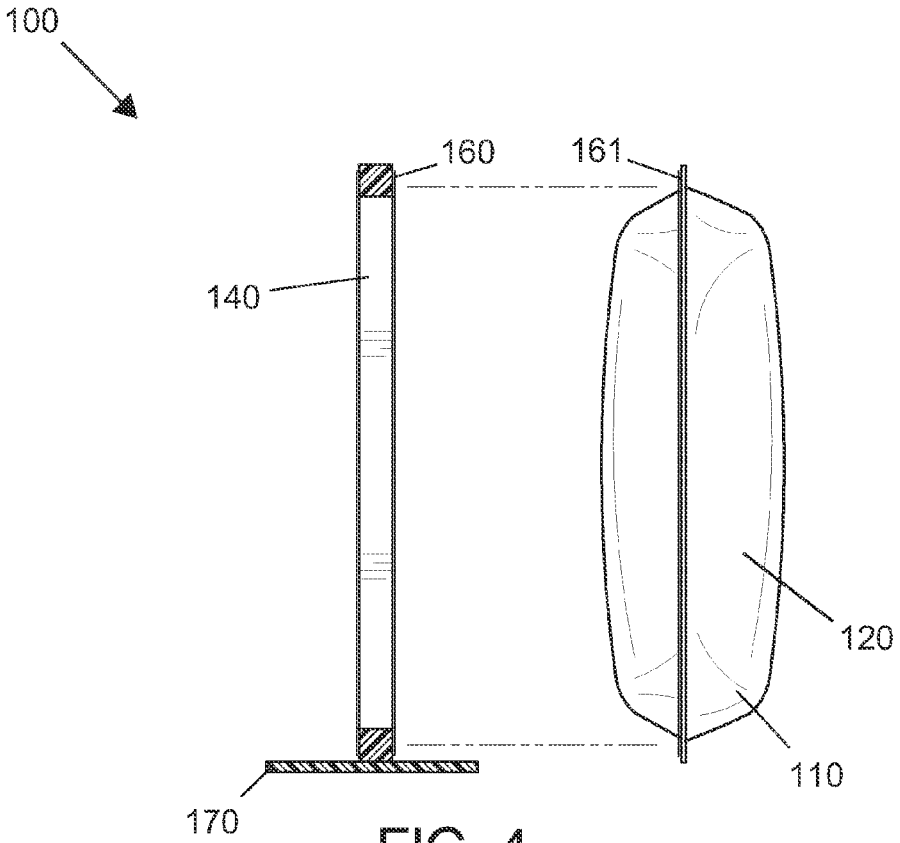
FIG. 4 shows a side view of the components of the present invention.
Figure 5:
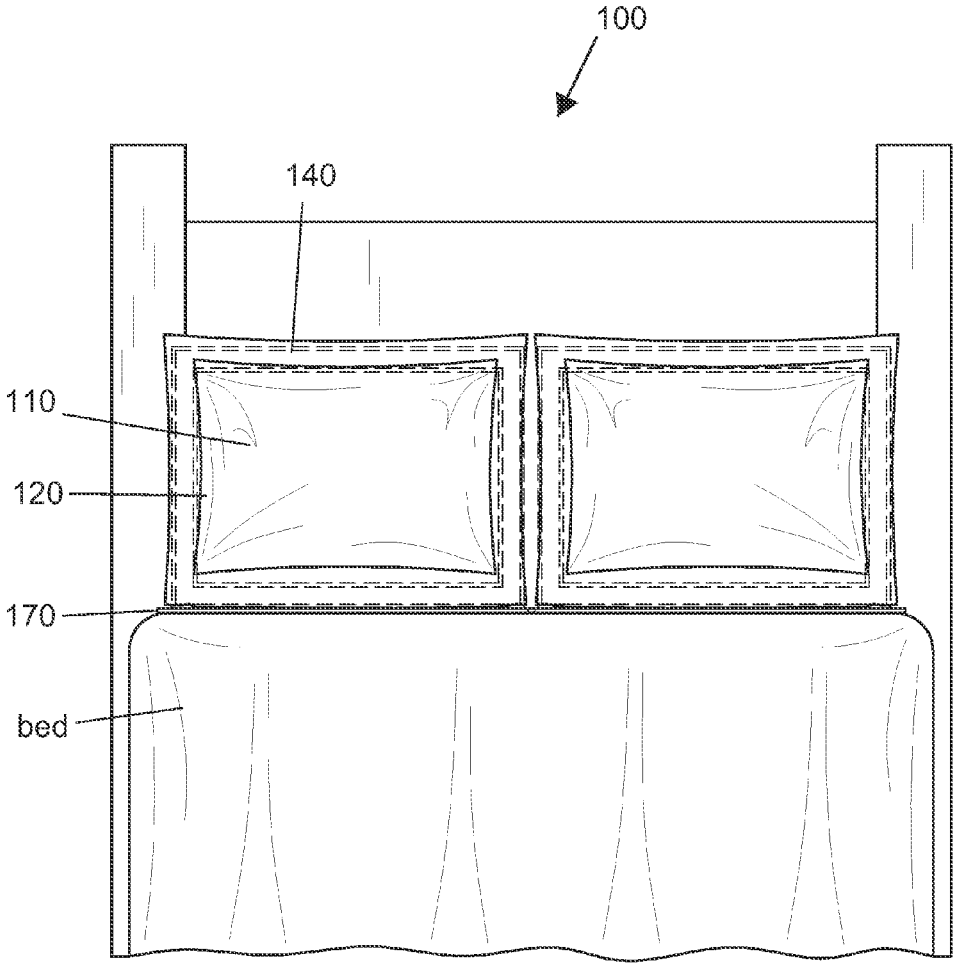
FIG. 5 shows a front view of the present invention in use.
Figure 6:
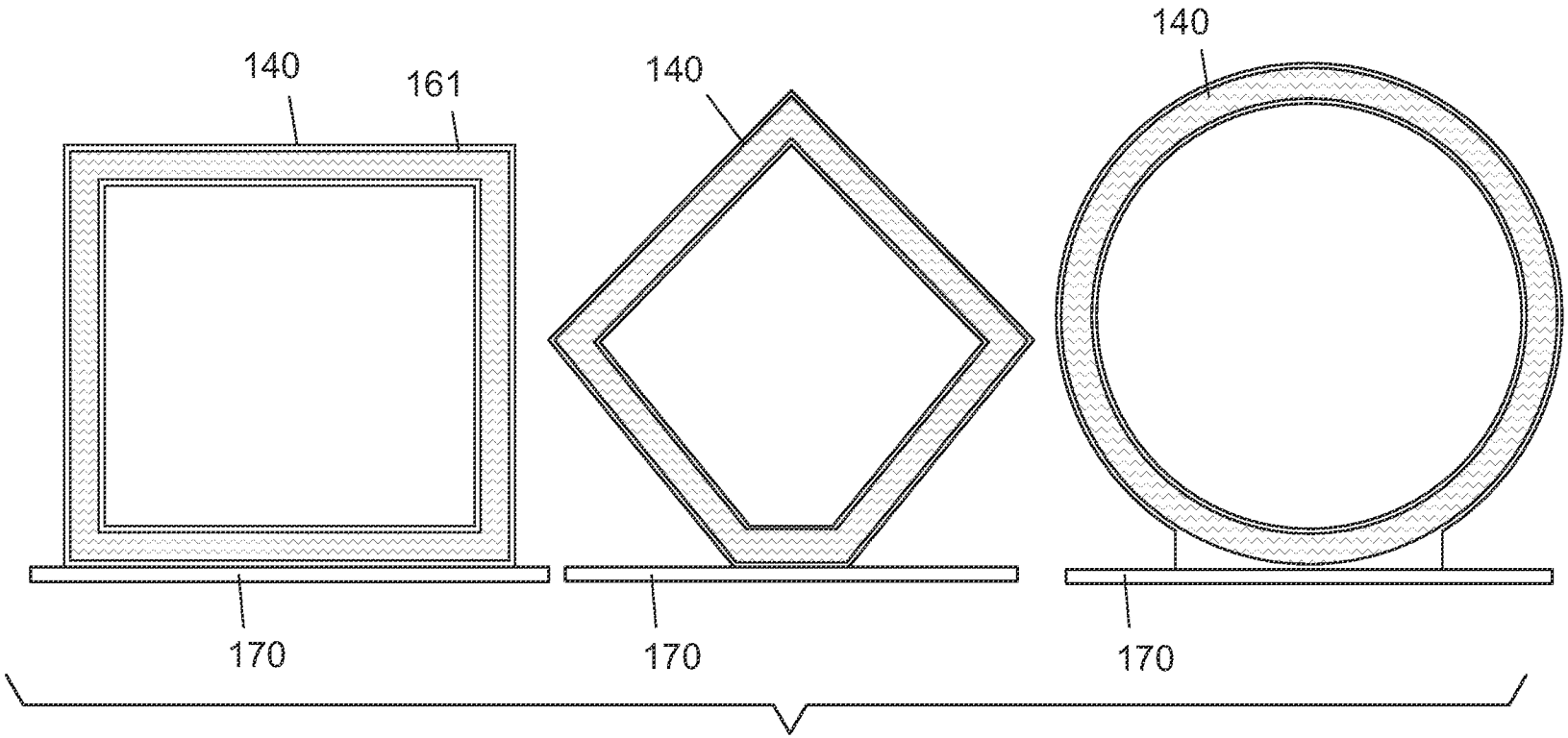
FIG. 6 shows alternate embodiments of the display frame of the present invention.
Figure 7:
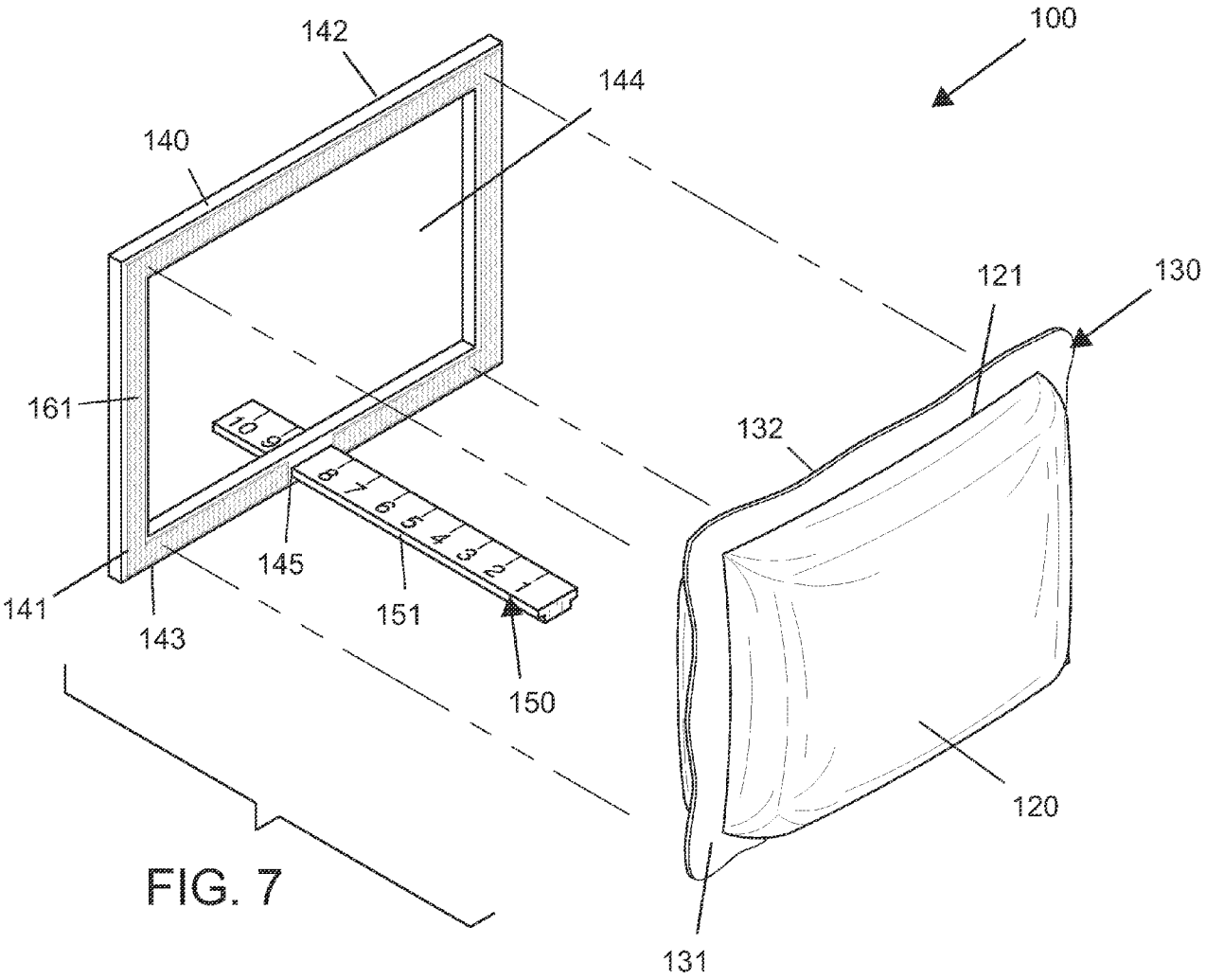
FIG. 7 shows a perspective view of an alternate embodiment of the present invention.
Figure 8:
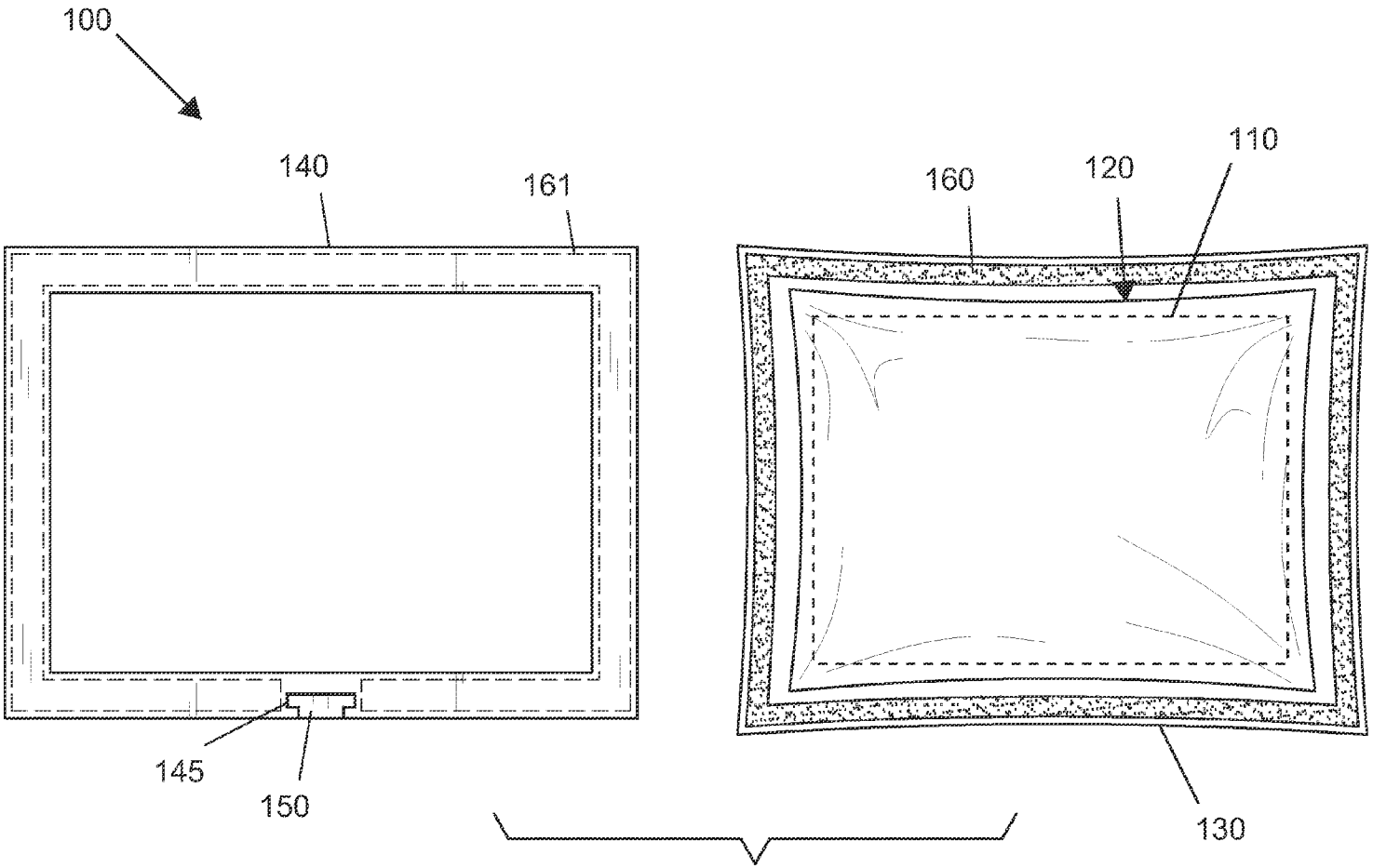
FIG. 8 shows a front view of an alternate embodiment of the present invention.
Figure 9:
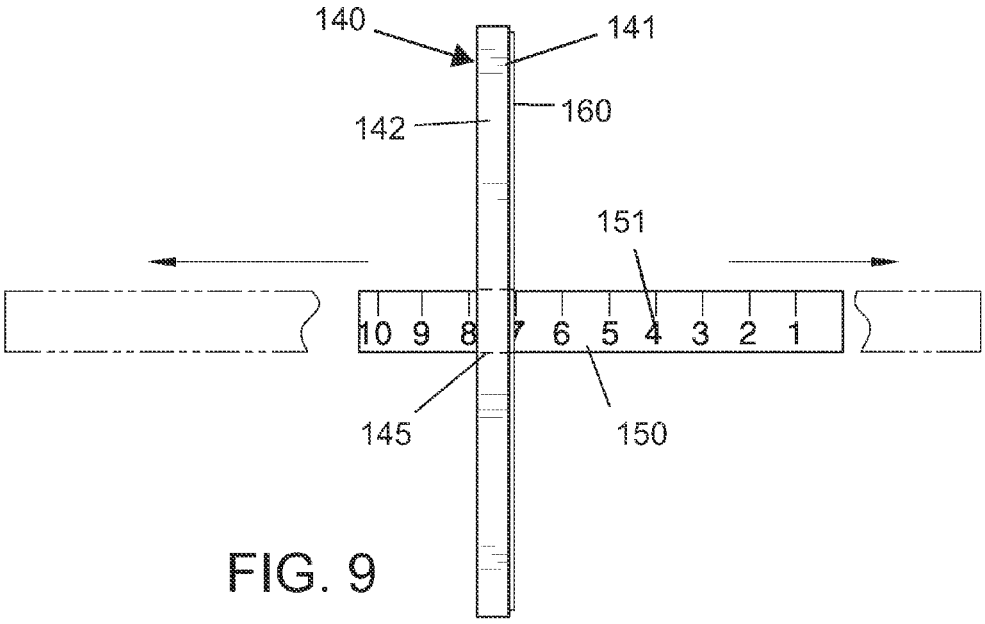
FIG. 9 shows a top view of an alternate embodiment of the display frame of the present invention.
Figure 10:
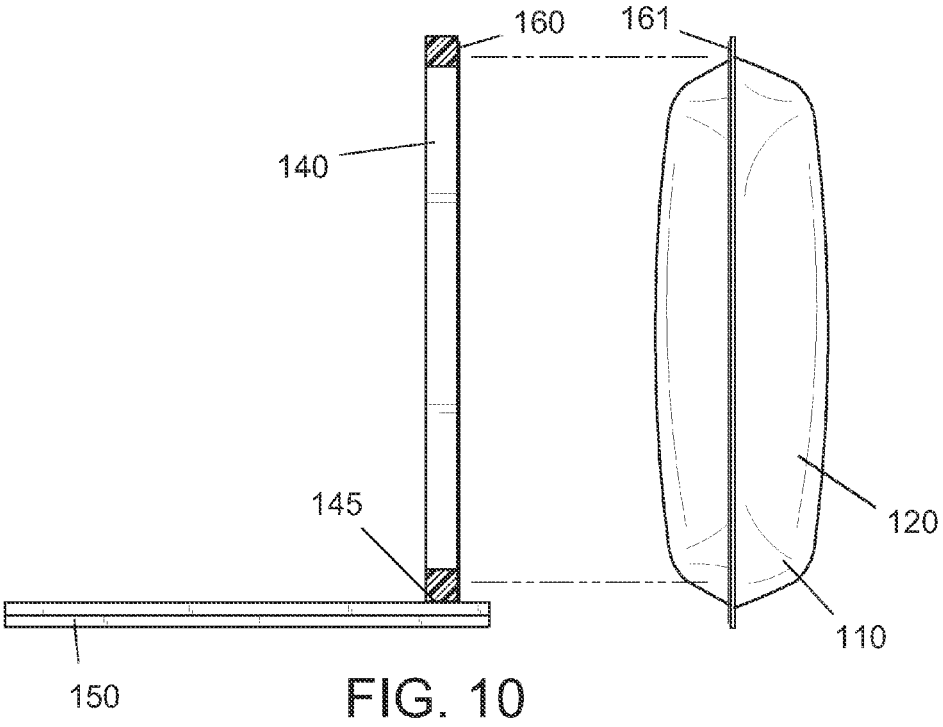
FIG. 10 shows a side view of an alternate embodiment of the present invention.
Figure 11:
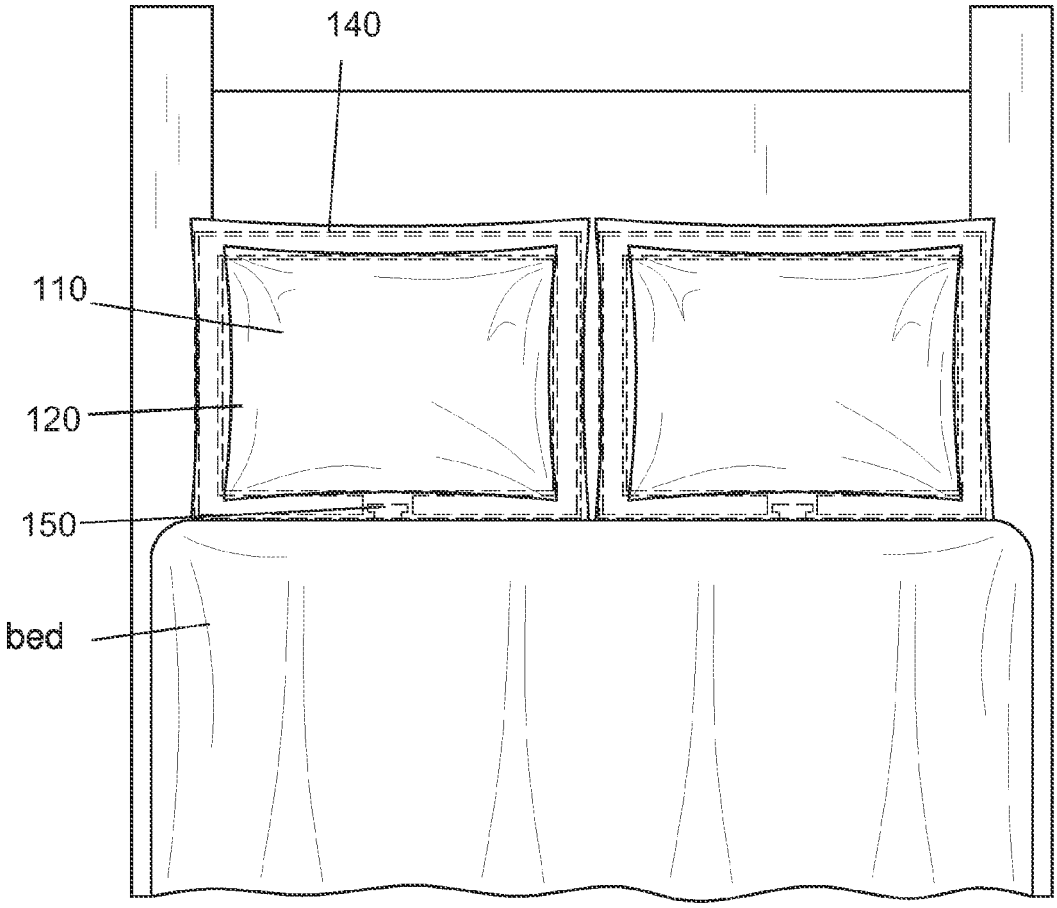
FIG. 11 shows a front view of an alternate embodiment of the present invention in use.
Figure 12:
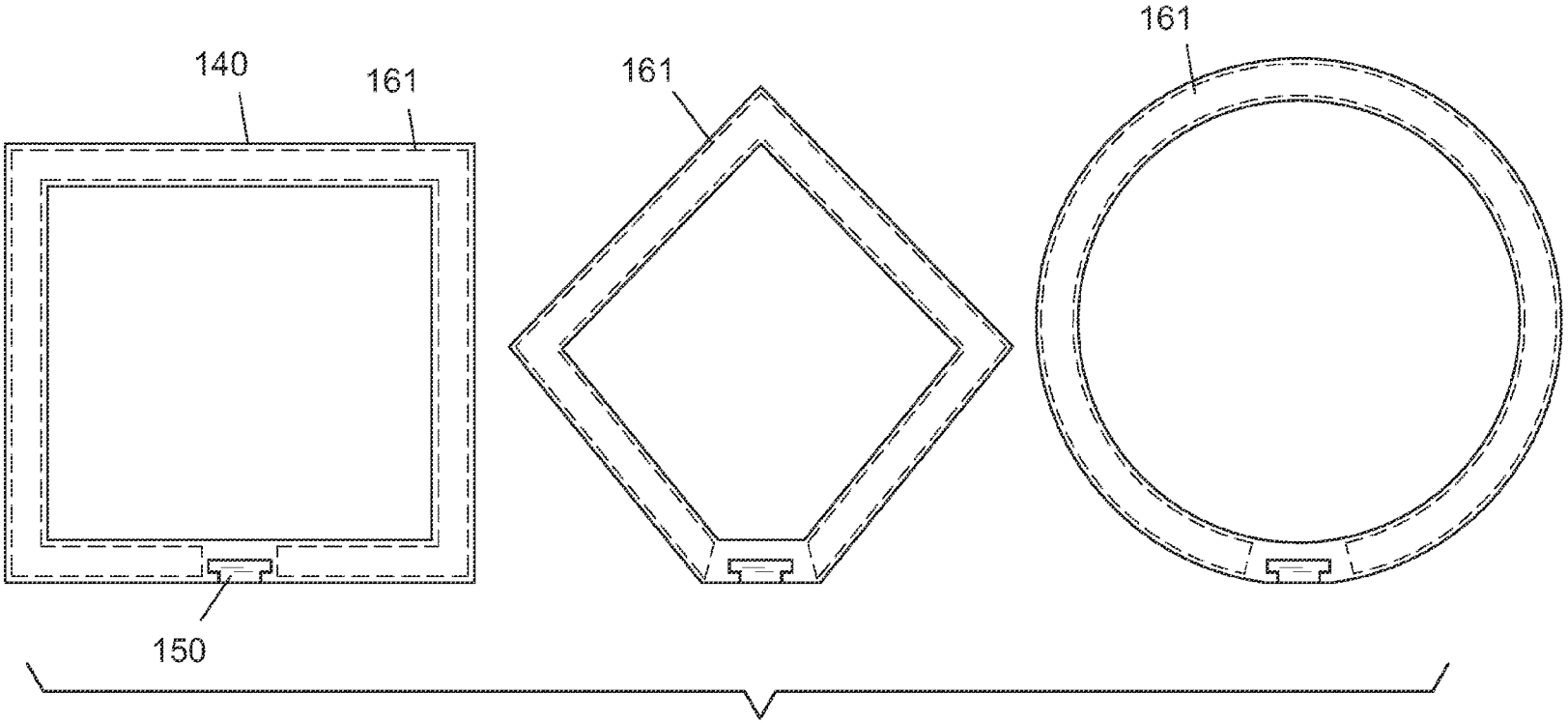
FIG. 12 shows alternate embodiments of the display frame of the present invention.

Following is a list of elements corresponding to a particular element referred to herein:

100 Pillow display system
110 Pillow
120 Sham
121 Sham outer periphery
130 Flange
131 Flange first surface
132 Flange second surface
140 Display frame
141 Frame first surface
142 Frame second surface
143 Frame bottom edge
144 Frame aperture
145 Groove
150 Stabilizer
151 Stabilizer surface
152 Mark of measurement
160 First attachment means
161 Second attachment means
170 Base
171 Base length
172 Base depth
181 Frame width
182 Frame thickness Referring now to FIG. 1-12, the present invention features a pillow display system (100) for displaying a pillow in a vertical position. In some embodiments, the system (100) comprises a pillow (110).

In some embodiments, the system (100) comprises a sham (120) disposed on and fully encasing the pillow (110). In some embodiments, the sham (120) comprises a flange (130) disposed on a sham outer periphery (121) thereon extending out and away from the sham (120). In some embodiments, the flange (130) comprises a flange first surface (131) and a flange second surface (132). In some embodiments, a second attachment means (161) is disposed on the flange second surface (132).

In some embodiments, the system (100) comprises a rigid display frame (140) having a frame bottom edge (143), a frame first surface (141), and a frame second surface (142). In some embodiments, a frame aperture (144) is centrally disposed in the display frame (140) therein. In some embodiments, a first attachment means (160) is disposed on the frame first surface (141).

In some embodiments, a removable base (170) is perpendicularly located on the frame bottom edge (143). In some embodiments, the removable base (170) comprises a base length (171) greater than a frame width (181) of the display frame (140). In some embodiments, the removable base (170) comprises a base depth (172) greater than a frame thickness (182) of the display frame (140). In some embodiments, the base (170) is oval or rectangular in shape. In some embodiments, the base (170) is weighted in comparison to the display frame (140), for example, the base (170) may weigh between 1 oz. and 8 oz. In some embodiments, the base (110) may weigh between 8 oz. and 16 oz. In some embodiments, the base (110) may weigh between 16 oz. and 32 oz. In some embodiments, the base (110) may weigh between 32 oz. or more. In some embodiments, the base (170) comprises a slot for the display frame (140) to snuggly slide into. In some embodiments, a clamp holds the base (170) on to the display frame (140). In some embodiments, the base (170) is held onto the display frame (140) via opposing magnetic force between the base (170) and the display frame (140). In some embodiments, the base (170) and the display frame are constructed from a metal. In some embodiments, the base (170) and the display frame are constructed from a plastic or a resin.

In some embodiments, the sham (120) is located on the pillow (110). In some embodiments, the flange second surface (132) is removably attached to the frame first surface (141) via the first attachment means (160) engaging the second attachment means (161). In some embodiments, the system (100) is positioned via placing the display frame (140) upon a bedding surface thereon.

In some embodiments, a groove (145) is disposed on the frame bottom edge (143). In some embodiments, a rigid linear stabilizer (150) is slidably disposed in the groove (145) perpendicular to the display frame (140).

In some embodiments, the sham (120) is disposed on the pillow (110). In some embodiments, the flange second surface (132) is removably attached to the frame first surface (141) via the first attachment means (160) engaging the second attachment means (161). In some embodiments, the system (100) is positioned via positioning the stabilizer (150) in the groove (145) and placing the display frame (140) upon a bedding surface thereon.

In some embodiments, the pillow (110) is a standard sized sleeping pillow having measurements about 20"×26". In some embodiments, the pillow (110) is a queen sized sleeping pillow having measurements about 20"×30". In some embodiments, the pillow (110) is a king sized sleeping pillow having measurements about 20"×36".

In some embodiments, the pillow (110) is a decorative pillow having measurements about 16"×16". In some embodiments, the pillow (110) is a decorative pillow having measurements about 26"×26".

In some embodiments, the display frame (140) is rectangular. In some embodiments, the display frame (140) is polygonal. In some embodiments, the display frame (140) is round. In some embodiments, the display frame (140) is elliptical.

In some embodiments, the first attachment means (160) and the second attachment means (161) are components of a mated hook and loop system. In some embodiments, the first attachment means (160) and the second attachment means (161) are easily replaceable.

In some embodiments, the stabilizer (150) comprises marks of measurement (152) disposed on a stabilizer surface (151) thereon.

In some embodiments, the system (100) may be any colors or animal prints. In some embodiments, a plurality of display frames (140) having pillows (110) mounted therein may be used in sequence.

As used herein, the term "about" refers to plus or minus 10% of the referenced number.

The disclosures of the following U.S. Patents are incorporated in their entirety by reference herein: U.S. Pat. No. D 382,755; U.S. Pat. No. D 257,105; U.S. Pat. No. 7,971,294; U.S. Pat. No. 6,839,923; U.S. Pat. No. 3,346,892; U.S. Pat. No. 2,986,202; U.S. Pat. No. 1,140,583; U.S. Pat. No. 929, 810; and U.S. Pat. No. 359,617.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pillow display system (100) for displaying a pillow in a vertical position, wherein the system (100) comprises:

(a) a pillow (110);

(b) a sham (120) disposed on and fully encasing the pillow (110), wherein the sham (120) comprises a flange (130) disposed on a sham outer periphery (121) thereon extending out and away from the sham (120), wherein the flange (130) comprises a flange first surface (131) and a flange second surface (132), wherein a second attachment means (161) is disposed on the flange second surface (132); and (c) a rigid display frame (140) having a frame bottom edge (143), a frame first surface (141), and a frame second surface (142), wherein a frame aperture (144) is centrally disposed in the display frame (140) therein, wherein a first attachment means (160) is disposed on the frame first surface (141), wherein a groove (145) is disposed on the frame bottom edge (143), wherein a rigid linear stabilizer (150) is slidably disposed in the groove (145) perpendicular to the display frame (140), wherein the sham (120) is disposed on the pillow (110), wherein the flange second surface (132) is removably attached to the frame first surface (141) via the first attachment means (160) engaging the second attachment means (161), wherein the system (100) is positioned via positioning the stabilizer (150) in the groove (145) and placing the display frame (140) upon a bedding surface thereon.

2. The system (1) of claim 1, wherein the stabilizer (150) comprises marks of measurement (152) disposed on a stabilizer surface (151) thereon.

* * * * *